United States Patent [19]

Jensen

[11] 3,965,688

[45] June 29, 1976

[54] UNDERWATER STRUCTURE, IN PARTICULAR FOR UNDERWATER DRILLING OPERATIONS

[75] Inventor: Peter Jensen, Boulogne, France

[73] Assignee: C. G. Doris, Paris, France

[22] Filed: July 24, 1974

[21] Appl. No.: 491,570

[30] Foreign Application Priority Data

July 25, 1973 France ..... 73.27245

[52] U.S. Cl. ..... 61/50; 61/52

[51] Int. Cl.[2] ..... E02D 27/00

[58] Field of Search ..... 61/46, 46.5, 50, 52, 61/34

[56] References Cited

UNITED STATES PATENTS

| | | | |
|---|---|---|---|
| 1,665,796 | 4/1928 | Sipe | 61/52 |
| 1,963,351 | 6/1934 | Clements et al. | 61/52 X |
| 2,385,341 | 9/1945 | Bayley | 61/46 X |
| 2,652,693 | 9/1953 | Goldman et al. | 61/46.5 |
| 2,705,403 | 4/1955 | Ebert | 61/34 X |
| 3,118,282 | 1/1964 | Jarlan | 61/4 |
| 3,402,559 | 9/1968 | Fukushima | 61/52 |

*Primary Examiner*—Jacob Shapiro

*Attorney, Agent, or Firm*—Wigman & Cohen

[57] ABSTRACT

A structure designed to rest upon the bed of a body of water, in particular to support fixed installations such as an off-shore drilling platform, comprising a central cavity without a base and surrounded by a double vertical wall spaced apart by vertical partitions, preferably of cylindrical shape, forming a plurality of compartments provided with bases at their bottom ends and extending above the double wall.

9 Claims, 12 Drawing Figures

UNDERWATER STRUCTURE, IN PARTICULAR FOR UNDERWATER DRILLING OPERATIONS

The present invention relates to structures designed to rest upon the bed of a body of water, for example to support fixed installations such as drilling platforms or platforms for the exploitation of submarine petroleum deposits.

It is well known to commence the construction of this kind of structure in a dry dock the base of which is below the sea level, and then to flood the dock so that the constructed part of the structure floats upon the water, then to tow said portion of the structure outside the dock and to progressively ballast the structure in order to increase its submerged depth as its construction proceeds. The completed structure is then towed to its final site and ballasted it until it sinks to the bottom.

In the known embodiments, the structure is designed in the form of a caisson with a base at its lower end in order to give it buoyancy. The vertical walls of the caisson generally extend a little beneath the base in order to form "spades" which penetrate into the sea bed and anchor the structure there. However, the base of the caisson must not touch the seabed because the movement of the water produces undermining tending to produce in the seabed beneath the base of the caisson a ridge-back formation so that there is the risk of the caisson toppling. It is therefore necessary to raise the base of the caisson and to limit the penetration of the "spades" by means of horizontal elements located beneath the base and generally arranged outside the caisson; the result is an increase in the cost of manufacture of the structure and in the horizontal dimensions thereof, making it necessary to increase the dimensions of the dock utilised at the commencement of construction. In addition, in the known embodiments, it is difficult to settle the structure on a seabed which is not level.

The object of the invention takes the form of improvements which make it possible to overcome these drawbacks and at the same time to secure a certain number of advantages which will be described hereinafter.

The structure in accordance with the invention comprises a central opening without a base, surrounded by double vertical wall, preferably cylindrical in shape, spaced apart by vertical partitions, preferably cylindrical in form to form a plurality of compartments provided with bases at their bottom ends. Certain at least of these partitions extend preferentially above the double wall which is normally immersed when the structure is in position, to form hollow pillars extending above the surface of the water in order to support installations such as a drilling platform. The bases of the compartments or hollow pillars form the buoyancy chambers which give the structure its buoyancy, and subsequently rest upon the seabed, limiting the penetration of the "spades" if these latter are provided. These bases thus form a double function. In addition, they can be located at different levels in relation to the internal edge of the vertical walls, so that the structure can rest upon a sloping seabed.

In one embodiment, three at least of the hollow pillars are extended upwards, that is to say they extend above elements of the structure which are designed to directly support the fixed installations. It is thus possible to float the structure off immersed or submerged, with the supporting elements sufficiently far below the water level to give passage to vessels which carry the elements of these installations; the hollow extended pillars form buoyancy chambers, which give the half immersed structure stability and also stabilise it whilst it is being unballasted beneath the vessels aforementioned, so that the elements in question progressively support the weight of the installations.

This feature forms part of the invention which also extends to a structure designed to rest upon the base of a body of water and comprising elements intended to directly support fixed installations such as a drilling platform, said platform comprising at least three hollow elements extending above said supporting elements, and designed to act as buoyancy chambers in order to give the submerged structure stability, said elements being immersed in the water.

The description which now follows with reference to the attached drawings given purely by way of non-limitative examples, will indicate the advantages of the invention and the method by which it is to be performed, the features contained both in the figures and the description falling, of course, within the scope of the invention.

Figure 1:
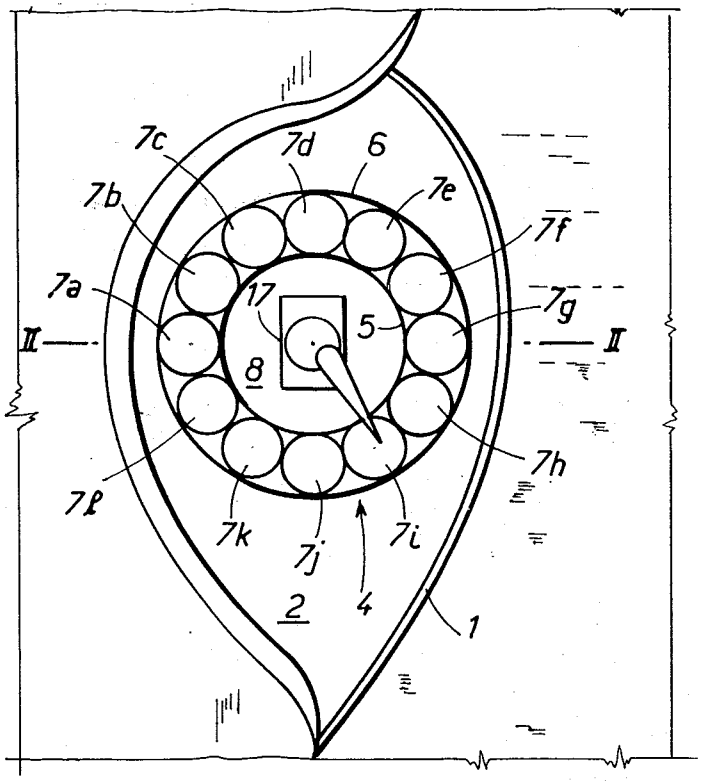
FIG. 1 is a plan view of the bottom part of the structure in accordance with the invention during the course of construction in a dry dock.
Figure 2:
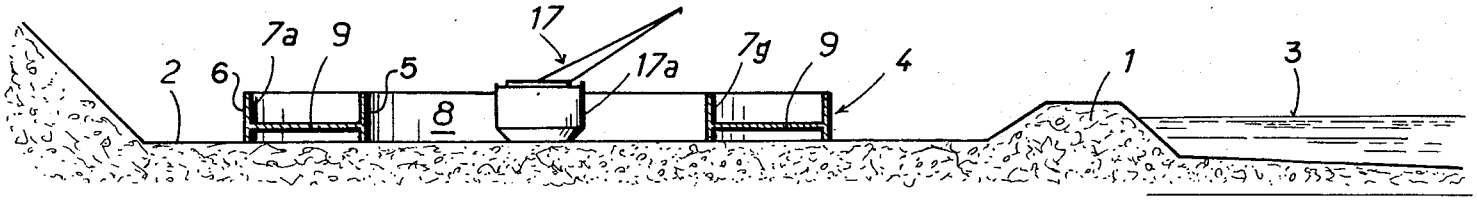
FIG. 2 is a sectional on a larger scale, taken on the line II—II of FIG. 1.

The figures illustrate the construction, equipping and erection in position, of a reinforced concrete structure designed to support an underwater drilling platform above the sea. For construction, a beach constituted by a cove close to a sheltered location in deep water, as encountered for example in a fiord, is chosen. The entrance to the cove is blocked by a sea wall 1 (FIGS. 1 and 2) and the beach is excavated away in order to form a basin or dock 2 with a flat horizontal base located below the level of the sea 3 and sufficiently large to contain the structure 4.

Figure 4:
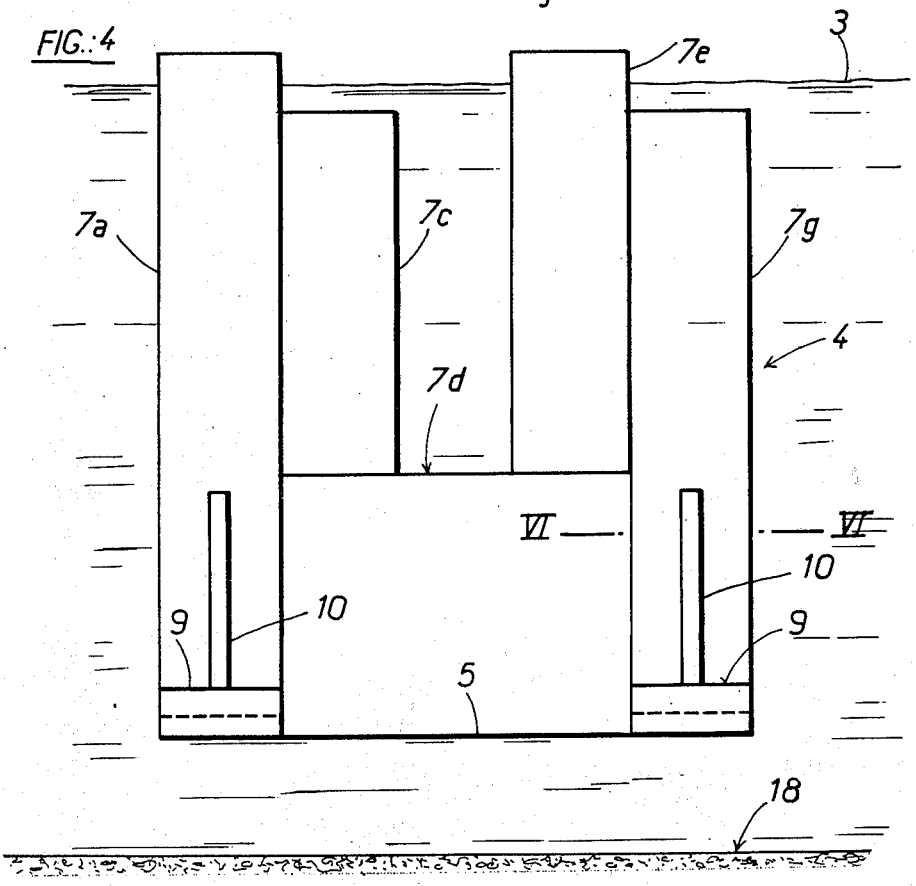
FIG. 4 is a sectional view on the line IV—IV of FIG. 3.

The structure 4 comprises two coaxial cylindrical walls 5, 6 with vertical axes, spaced apart by a plurality of contiguous vertical cylinders *7a*, *7b*, *7c*, *7d*, *7e*, *7f*, *7g*, *7h*, *7i*, *7j*, *7k*, *7l*. The central opening 8 surrounded by the internal wall 5 has no base, whilst the contiguous vertical cylinders *7a–7l* are provided with respective bases 9. The base 9 in each of the cylinders is traversed by a tube 10 (not shown in FIGS. 1 and 2), the purpose of which will be explained hereinafter. These vertical cylinders, between the walls 5 and 6, delimit internal spaces 11 and external spaces 12 in the form of curvilinear triangles (see FIGS. 5 and 6). Certain spaces 11 and 12 have bases 13, 14 traversed by openings 15, 16 (see also FIGS. 11 and 12) the purpose of which will likewise be explained at a later point. Before completing the dyke or sea wall 1, the precaution will have been taken of introducing into the basin or dock 2 (FIGS. 1 and 2) a concrete centre 17 arranged upon a floating pontoon 17*a*, and the pontoon will have been beached so to speak at the centre of the dock when the latter was pumped dry. With the help of the concrete centre 17 and around same, the bottom part of the structure 4 is built up until a height of around 5 metres is reached. Then, the water is admitted to the dock after having plugged the tubes 10 (FIG. 4), so that the cylinders 7*a* to 7*l* act as buoyancy chambers and support the structure 4 above the seabed. The pontoon 17*a* also floats; the pontoon is then moored to the structure 4 and the sea wall 1 is opened over a sufficient length to give passage to the structure which latter is towed out to the sheltered deep water location (FIG. 4).

Figure 3:
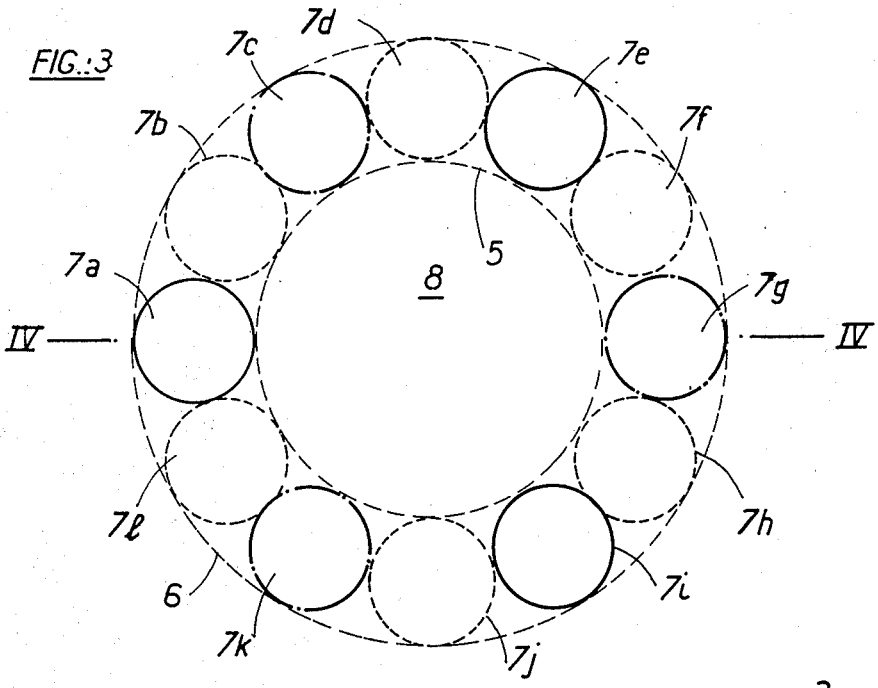
FIG. 3 is a plan view of the completed structure afloat, before the installation of the drilling platform.

The construction of the structure then continues with the help of the concrete centre 17. The cylinders 7*a* to 7*l* are progressively ballasted so that the structure sinks progressively as its height increases. In the embodiment illustrated, the structure has an overall diameter of around 100 meters and each of the cylinders 7*a* to 7*l* has a diameter of around 20 meters; the structure is designed to rest upon the seabed at a depth around 80 meters. The height of the walls 5 and 6 and of the cylinders 7*b*, 7*d*, 7*f*, 7*h*, 7*j* and 7*l* (shown in broken line in FIG. 3) is of the order of 45 meters, whilst the construction of the cylinders 7*c*, 7*g* and 7*k* (shown in chain dotted fashion) is continued for a further 60 meters, and the cylinders 7*a*, 7*e* and 7*i* are built up for a further 10 meters, making them in other words 70 meters longer than the walls 5 and 6. As we shall see later on, the cylinders 7*c*, 7*g* and 7*k* are designed to form hollow pillars upon which the drilling platform will rest, the platform being attached to the cylinders 7*a*, 7*e* and 7*i* which are the extended hollow pillars. The bottom 18 of the body of water at the construction location will be deeper than 110 metres beneath the surface 3, and at the end of the construction phase the tips of the cylinders 7*a*, 7*e* and 7*i* will be all that is left projecting above the surface 3; these three cylinders form buoyancy chambers which are adequate to give the structure stability in the immersed or semi-immersed position.

Figure 7:
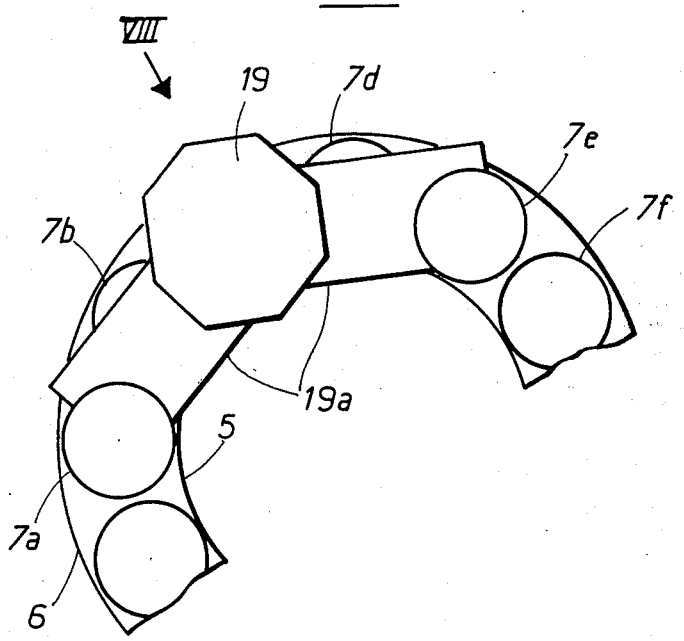
FIG. 7 is a fragmentary view similar to that of FIG. 3, illustrating the installation of a drilling platform element.
Figure 8:
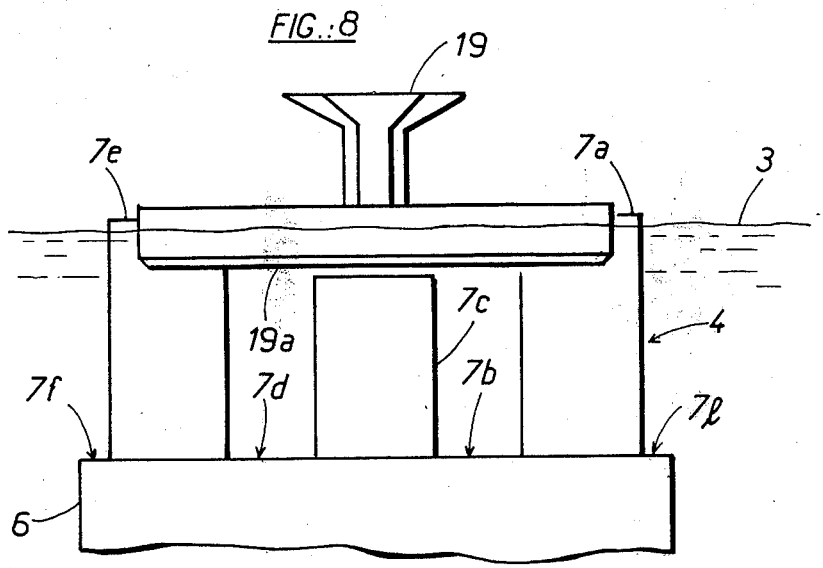
FIG. 8 is an elevational view in accordance with arrow VIII of FIG. 7.

The construction completed, the structure 4 is held in this position and the concrete centre is evacuated by floating its pontoon 17*a* over the submerged cylinders. During the building of the structure 4, drilling platform elements such as a platform element 19 (FIGS. 7 and 8) will have been prepared which will have been assembled on bases such as a pontoon 19*a* acting as floating pontoons, and, whilst the structure 4 is still in the submerged position, each of these pontoons 19*a*, is moved into position above a cylinder or pillar, for example, above the cylinder 7c so that it is enclosed between the two projecting cylinders or pillars 7*a* and 7*e*. Then, the cylinders 7*a* to 7*l* are progressively unballasted so that the pontoons 19*a* come to rest upon the pillars 7*c* and thus form the bases for the drilling platform which latter is attached firmly to the projecting pillars such as

7*a* and 7*b* by means which have not been shown, for example by bolts.

It should be pointed out that this method of positioning of the drilling platform requires that that portion of the structure upon which it is to rest, can be submerged and this is made possible by the fact that the extended hollow pillars 7*a*, 7*e* and 7*i* act as buoyancy chambers which then emerge above the surface 3 of the body of water. Three at least of these buoyancy chambers are required to give the structure stability in the submerged position and especially during the progressive unballasting operation carried out in order to transfer to it the weight of the drilling platform. The prior art structure cannot comprise any elements located above the plane of installation of the platform, which could act as buoyancy chambers, so that it is impossible to submerge said plane or level, without completely immersing the structure and therefore seriously compromising its stability. The plane of installation must therefore be maintained at a certain level above the water level and the positioning of the drilling platform, which weighs several hundred tons, presents extremely difficult problems.

Figure 9:
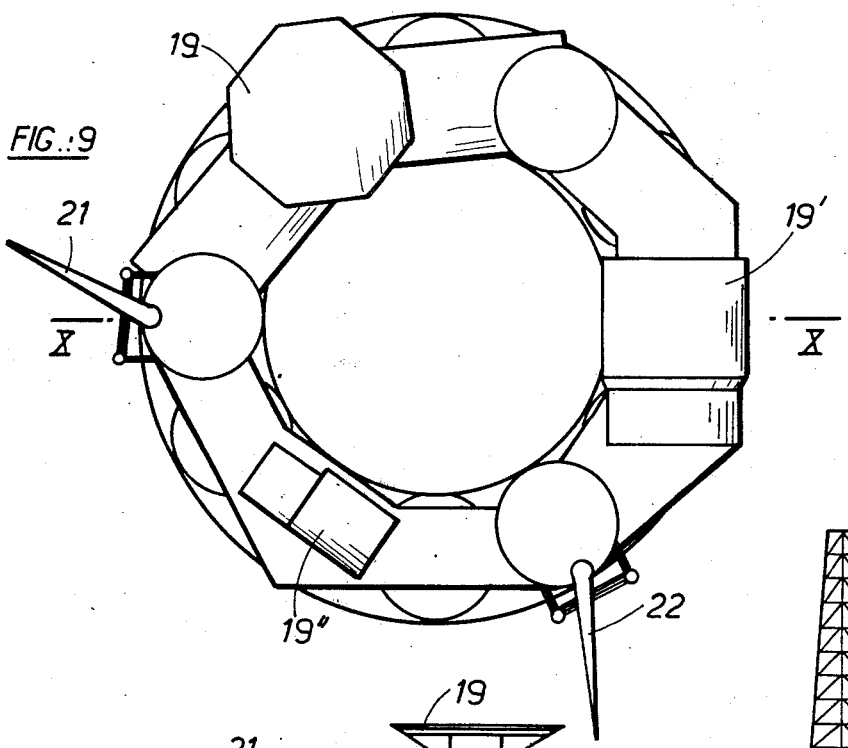
FIG. 9 is a plan view of the completed structure.
Figure 10:
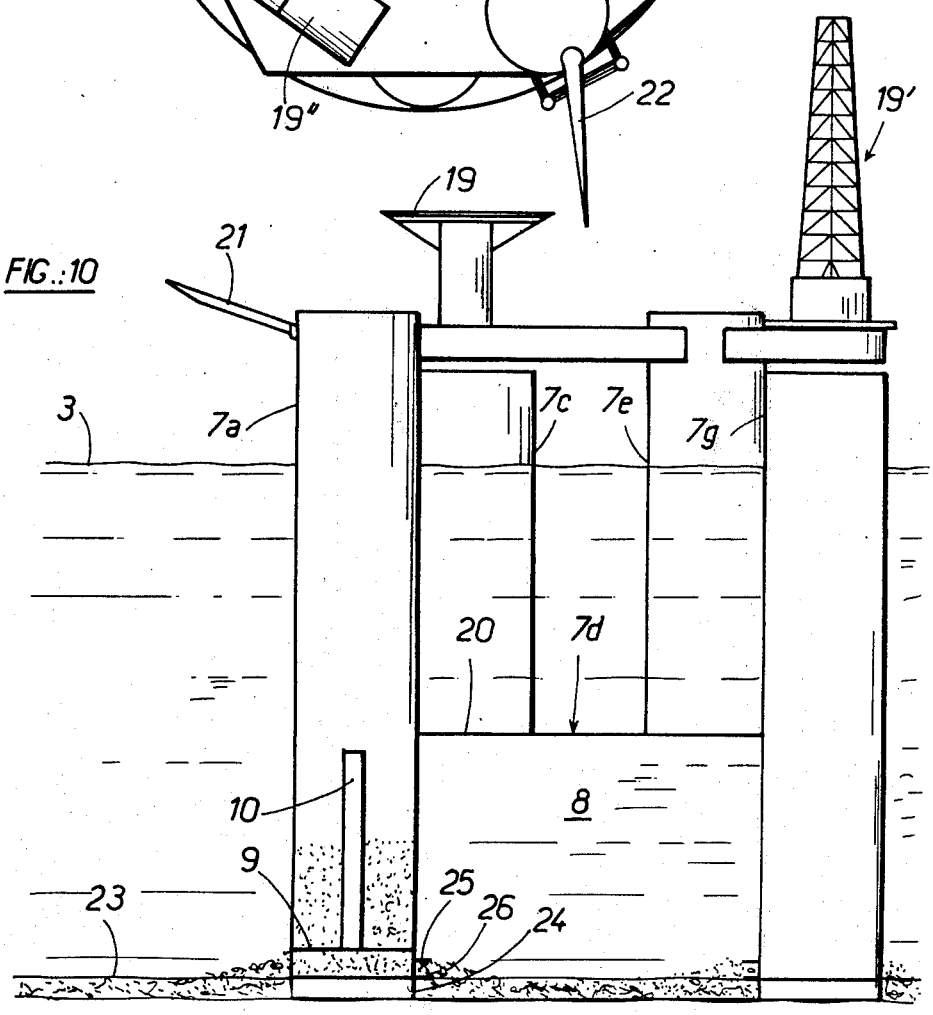
FIG. 10, is a sectional view of the line X—X of FIG. 9, showing the strucutre in its final position.

When the structure 4 is thus equipped, the cylinders 7*a* to 7*l* are unballasted until the depth of the submerged portion is reduced to the minimum compatible with stability, this in order to reduce the resistance to motion through the water, and the structure is then towed to the site of its final installation where the cylinders are very heavily ballasted so that the structure rests heavily upon the bed 23 of the sea (see FIGS. 9 and 10). This ballasting can be carried out cheaply because it is generally sufficient to open the tubes 10 passing through the bases of the cylinders 7*b*, 7*d*, 7*f*, 7*h*, 7*j* and 7*k* in order to flood them and thus cause the structure to sink down to the level 20 of the top edge of the walls 5 and 6 of these cylinders, whereupon ballast (sand, gravel or shingle) brought by barges, can be dumped into them. Self-evidently, a calm period will be chosen in order to perform the operations of towing out and ballasting.

The platform elements which have been installed whilst the structure was immersed (position shown in FIG. 8) comprise in particular, in the embodiment illustrated in FIGS. 9 and 10, a helicopter landing pad 19, a derrick structure 19′ and a power plant 19″. They also comprise lifting gear 21, 22 enabling barges to deliver equipment designed for installation on the platform, or materials, for example ballast for the completion of the ballasting operation.

Figure 5:
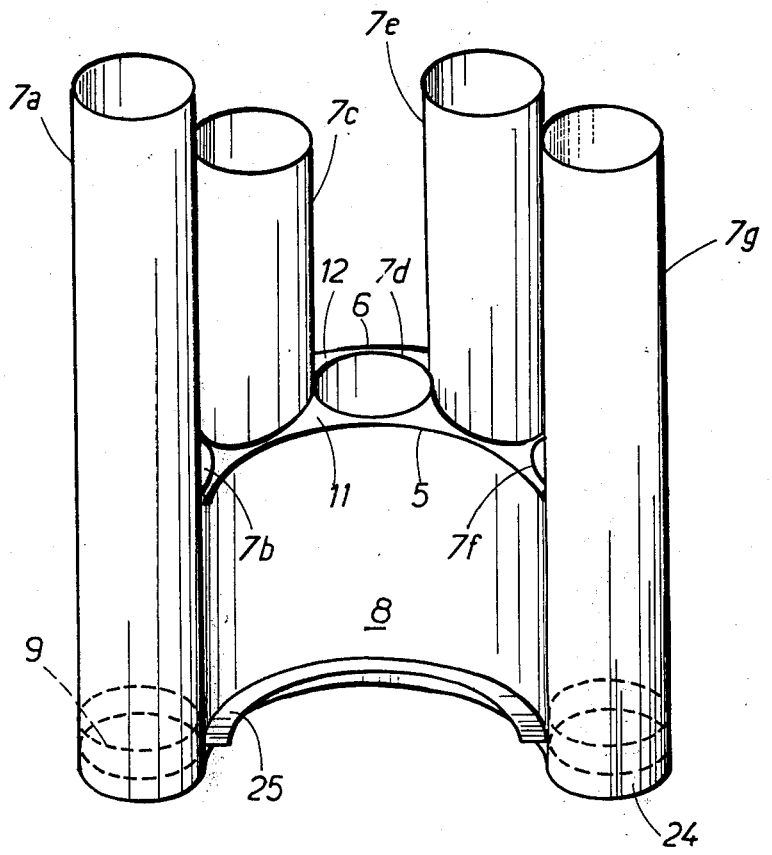
FIG. 5 is a perspective cut-away view of part of the structure of FIG. 4.
Figure 6:
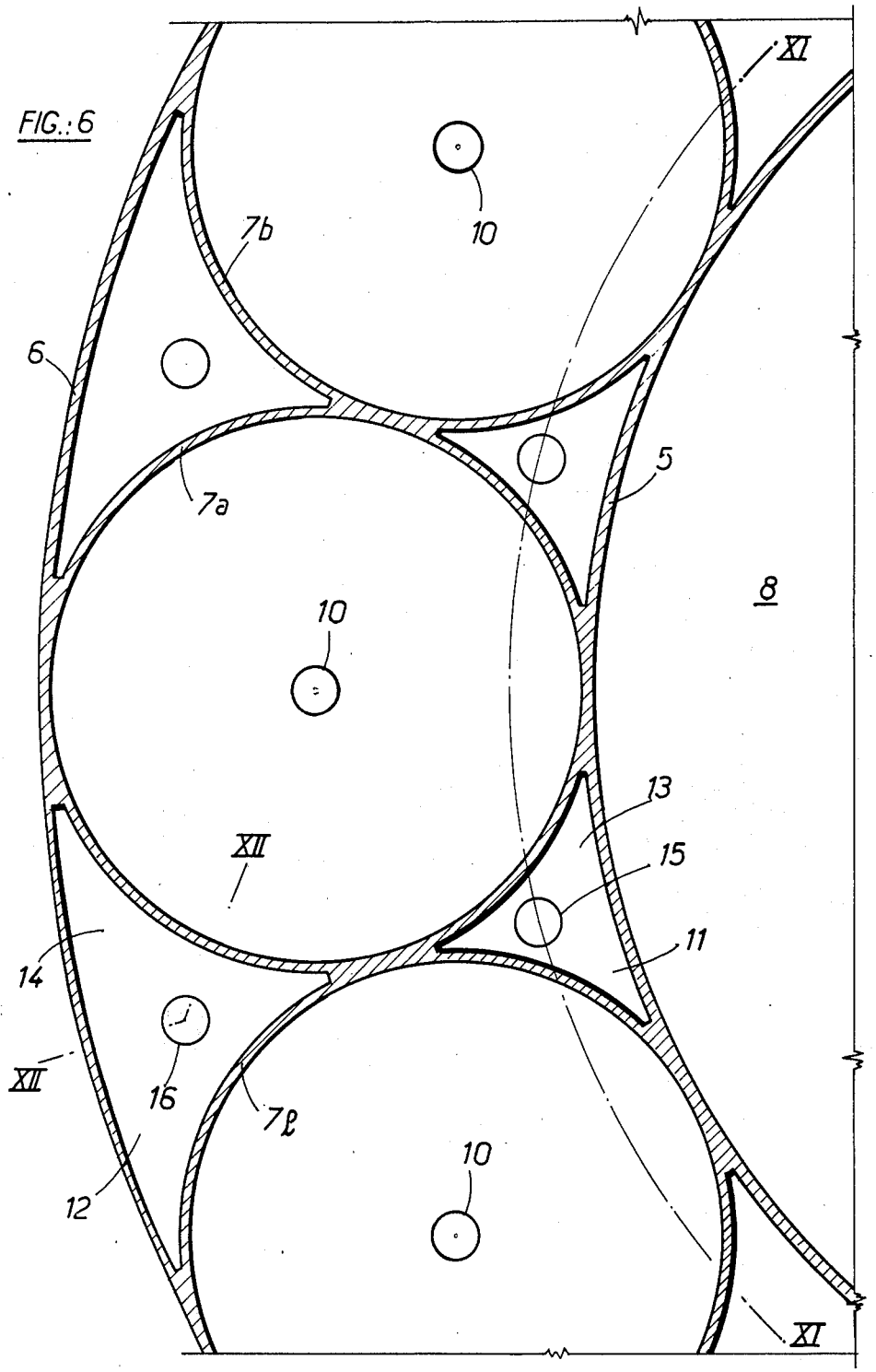
FIG. 6 is a sectional view on a still larger scale, taken on the line VI—VI of FIG. 4.

In FIG. 6, the structure can be seen which is built in such a fashion that the walls of the cylinders are attached to one another and to the cylindrical walls 5, 6. These cylinders 7*a* to 7*l* thus form a reinforced concrete network which defines the spacing between the double wall 5, 6 and give it great mechanical strength. The construction is carried out, in a manner known per se, by pouring concrete around the reinforcing elements (not shown) into formwork elements (not shown) which are slid upwards as building progresses. The hollow pillars 7*c*, 7*g*, 7*k* and the extended hollow pillars 7*a*, 7*e* and 7*i* are solidly rooted in this double wall which acts as a foundation for them. This rests heavily upon the seabed as explained earlier, and is furthermore anchored in the seabed 23 by means of "spades" 24 which prevent it from drifting, as well as by a "cap" 25 which prevents it from toppling. The "spades" 24 are constituted by portions of the walls 5,

6 and portions of the cylinders which extend beneath the bases 9, 13 and 14 and penetrate into the seabed 23. As far as the "cap" 25, this is an annular flange or rib on the wall 5, which extends horizontally towards the interior of the opening 8 (FIG. 5). Into this opening 8, against said wall 5, ballast 26 (FIG. 10) is dumped which bears on the "cap" 25 and prevents the structure from lifting and toppling.

Figure 12:
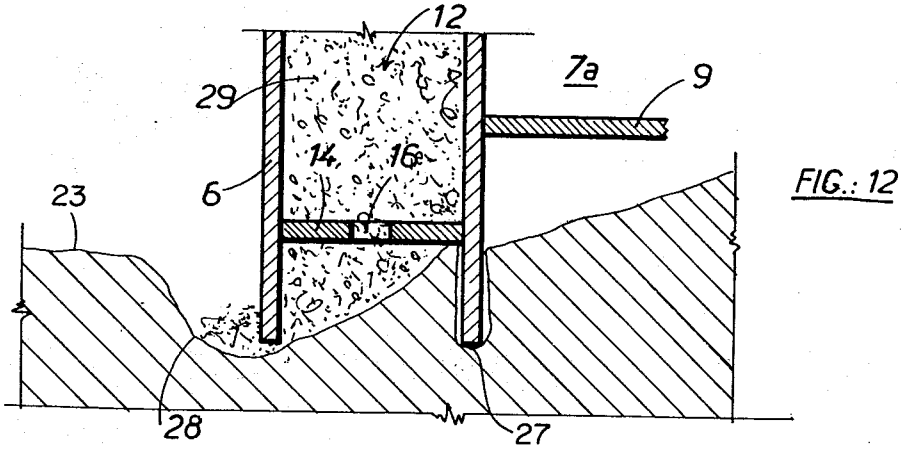
FIG. 12 is a sectional view on the broken line XII—XII of FIG. 6.
Figure 11:
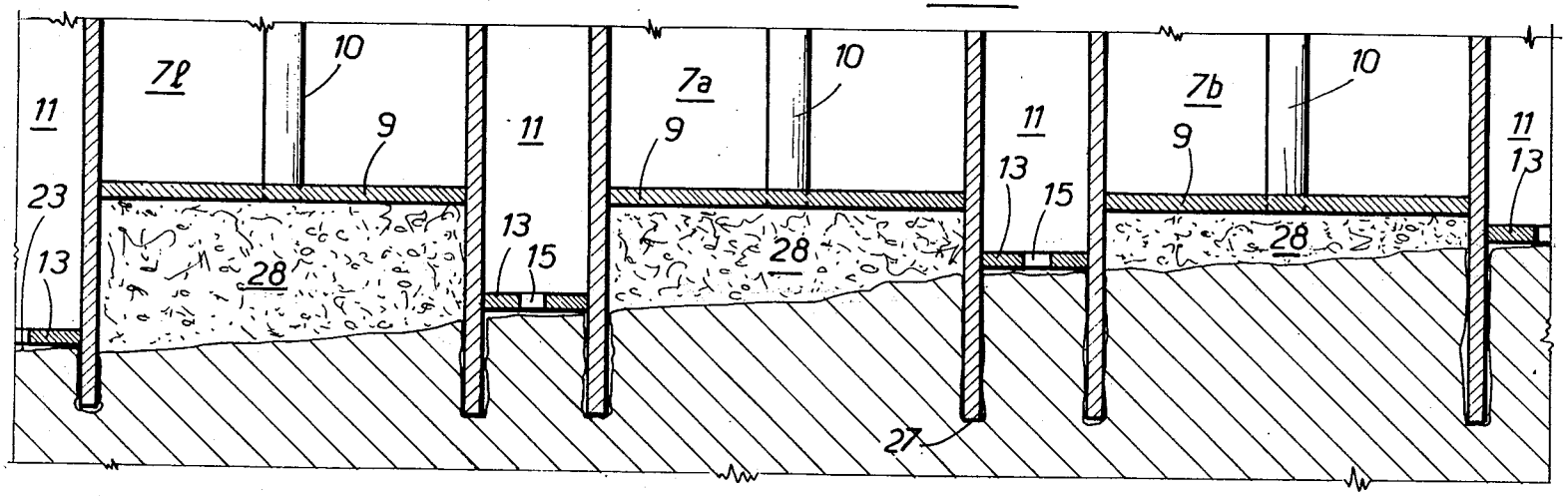
FIG. 11 is a development of a sectional view on the line XI—XI of FIG. 6.

In the embodiment shown in FIGS. 11 and 12, the seabed 23 slopes. The bases 13, 14 of the spaces 11, 12 are located, above the bottom edge 27 of the spades, at different heights which have been designed prior to building so that the cylinders *7a* to *7l* are substantially vertical when the structure is placed in its final position, and so that the bases 13, 14 rest upon the seabed. The bases 9 of the cylinders are located slightly higher and the alignment of the structure is adjusted so that the cylinders are strictly vertical, this by injecting concrete 28 beneath the bases 9, through the tubes 10.

As FIGS. 5 and 10 show particularly clearly, the height of the walls 5, 6 and the cylinders *7b*, *7d*, *7f*, *7k*, *7j* and *7l*, is only a fraction of the height of the structure so that the inwardly facing surface of the internal wall 5 and the outwardly facing surface of the external wall 6 are water-wetted and along with the cylinders are submerged quite deeply beneath the surface of the water, only the spaced pillars *7a*, *7c*, *7e*, *7g*, *7i* and *7k* which support the drilling platform, actually standing out of the water. The spaced pillars are less vulnerable to the effects of wave action and wind, than are conventional structures where the whole of the mass emerges above the surface of the water.

It is also possible to make the structure less vulnerable by damping wave energy through the use of projecting obstacles (not shown), distributed over the surface of the pillars in accordance with the disclosure of U.S. patent application Ser. No. 324,305, filed Jan. 17, 1973 and assigned to the assignee of the present invention; and/or by equipping the walls of these hollow pillars with perforations (not shown), for example, in accordance with the disclosure of U.S. patent application Ser. No. 358,500, filed May 9, 1973, now U.S. Pat. No. 3,846,988 and assigned to the assignee of the present invention. Means can be provided to close off the perforations during construction and towing, so that the cylinders can properly perform their buoy- Perforations (not shown) can be provided in the external wall 6 in accordance with the disclosure of U.S. patent application Ser. No. 391,465, filed Aug. 24, 1973 and U.S. patent application Ser. No. 461,347, filed Apr. 16, 1974 both assigned to the assignee of the present invention, in order, in the neighbourhood of the bottom edge 27, to create a water circulation effect which prevents undermining of the base of the structure, these perforations will preferably open into the spaces 12.

However, even if this precaution is adopted, undermining such as that shown at 28 of FIG. 12, may yet occur. In accordance with a feature of the invention, this drawback is overcome by filling the spaces 11 and 12, or certain of them at least, with ballast, sand, gravel or shingle. If undermining of the wall 6 and/or the wall 5 takes place, this ballast 29 passes through the holes 15 and/or 16 and fills up the undermined zones as they are produced, thus preventing any risk of the structure toppling. By keeping a watch on the level of the ballast 29 in the spaces 11, 12 forward notice that undermining is taking place is obtained, before it has gone sufficiently far to jeopardise the structure. It should be pointed out that the ballast can be supplied cheaply since it is merely necessary to dump it directly from barges into the spaces 11 and 12. If the wall 6 contains openings, the ballast will be made up of shingle, having a larger size than the wall openings.

It goes without saying that if certain of the cylinders *7a* to *7e* contain openings and ballast, then in this case too, the ballast will be made up of large shingle.

The cylinders *7a* to *7 l* offer various possibilities which have not been illustrated by the drawing, for example:

a. Certain of the cylinders can have their bases 9 omitted, so that they can be used for drilling operations. For example, in FIG. 10, the derrick 19' could be equipped with a drill pipe passing through the cylinder 7g which could be provided without a base.

b. If drilling for petroleum or gas is carried out in this fashion through a cylinder, then the latter can be utilised afterwards for extraction, rendering that operation easier. Moreover, in the event of any accident, the petroleum or gas will escape above the surface of the water so that the consequences of such accident are less serious. The particular cylinder involved can be reinforced, for example by hooping it, in order to increase its mechanical strength.

c. Certain of the cylinders can be used to store petroleum or to drill an access shaft to a reservoir, natural or artifically produced, located beneath the seabed.

d. Also certain of the cylinders, left without a base for the purpose, can be used for the operation of displacing mud or silt covering the seabed at the location of the structure, prior to the setting down of the latter, by means of airjets or waterjets.

e. It is possible to utilise certain of the cylinders, from which the bases have been omitted for the purpose, as diving bells in order to check the condition of the seabed during the operation of the structure. For this purpose, it is merely necessary to maintain each of these cylinders at a certain air pressure and to equip them with an airlock at the top.

I claim:

1. A structure designed to rest sunken upon the bed of a body of water in order to support on said bed fixed installations such as an off-shore drilling platform, comprising a vertical inwardly water-wetted internal wall defining a water-flooded central cavity having an open upper end and an open lower end, an outwardly water-wetted external wall defining a space between the external wall and the internal wall, a plurality of partitions extending vertically in said space to define a plurality of compartments therein and including a plurality of wall members projecting above said internal and external walls to form a plurality of hollow pillars uprising from said bed for supporting said fixed installations on said bed, and a plurality of base walls bottoming at least some of said compartments.

2. A structure as claimed in claim 1, in which the partitions are cylindrical.

3. A structure as claimed in claim 1, comprising elements for supporting said fixed installations, in which at least three of said hollow pillars extend above said elements in order to form buoyancy chambers which enable the submerged structure to be supported with said elements immersed in the water.

4. A structure as claimed in claim 1, comprising "spades" beneath said base walls, to penetrate into the bed of the body of water in order to prevent the structure from drifting, and a flange on the internal wall extending horizontally into the central cavity.

5. A structure as claimed in claim 4, comprising heavy materials discharged into the the central cavity of the platform resting upon the bed of the body of water, the materials covering said flange.

6. A structure as claimed in claim 1, in which said base walls are located at different heights above the bottom level of the structure.

7. A structure as claimed in claim 6, in which a certain number of compartments comprise tubes for the injection of concrete through the base walls.

8. A structure as claimed in claim 1, comprising openings in the base walls of a certain number of compartments defined between the partitions and at least one of said vertical walls.

9. A structure as claimed in claim 1, in which a certain number of said hollow pillars are open at their bottom ends.

* * * * *

UNITED STATES PATENT AND TRADEMARK OFFICE

CERTIFICATE OF CORRECTION

PATENT NO. : 3,965,688

DATED : June 29, 1976

INVENTOR(S) : Peter Jensen

It is certified that error appears in the above-identified patent and that said Letters Patent are hereby corrected as shown below:

The title should read:

UNDERWATER STRUCTURES, IN PARTICULAR FOR UNDERWATER DRILLING OPERATIONS

Column 1, line 18, after "ballasted" delete "it";

Column 2, line 46, change "strucutre" to --structure--;

Column 5, line 46, after "buoy-" insert --ancy chamber roll--.

Signed and Sealed this

Thirtieth Day of November 1976

[SEAL]

*Attest:*

RUTH C. MASON
*Attesting Officer*

C. MARSHALL DANN
*Commissioner of Patents and Trademarks*